United States Patent [19]

Clements

[11] 4,275,869

[45] Jun. 30, 1981

[54] AIR CUSHION LIFTING DEVICE

[75] Inventor: Harold J. Clements, Canterbury, England

[73] Assignee: Frank B. Dehn & Co., London, England

[21] Appl. No.: 518

[22] Filed: Jan. 2, 1979

[30] Foreign Application Priority Data

Jan. 5, 1978 [GB] United Kingdom ..... 377/78

[51] Int. Cl.[3] ..... B66F 3/24

[52] U.S. Cl. ..... 254/89 H; 254/93 HP

[58] Field of Search ..... 254/93 HP, 89 H

[56] References Cited

U.S. PATENT DOCUMENTS

| | | | |
|---|---|---|---|
| 1,149,114 | 8/1915 | Carlock | 254/93 HP |
| 2,804,118 | 8/1957 | Bayerkohler | 254/93 HP |
| 2,938,570 | 5/1960 | Flajole | 254/93 HP |
| 3,500,948 | 3/1970 | Williamson et al. | 254/93 HP |
| 4,061,310 | 12/1977 | Vetter | 254/93 HP |

FOREIGN PATENT DOCUMENTS

| | | |
|---|---|---|
| 791717 | of 1958 | United Kingdom . |
| 982064 | of 1965 | United Kingdom . |
| 1104520 | of 1968 | United Kingdom . |
| 1242008 | of 1971 | United Kingdom . |
| 1434806 | of 1976 | United Kingdom . |
| 1449830 | of 1976 | United Kingdom . |

*Primary Examiner*—Robert C. Watson

*Attorney, Agent, or Firm*—Bacon & Thomas

[57] ABSTRACT

A lifting cushion apparatus is equipped with five inflatable compartments. Each of the compartments extends the full length of the cushion and is connected to adjacent compartments by air ways. Several cushions may be connected to a common source of compressed air. The cushions may be stacked with the compartments interconnected in the vertical direction by apertures. In use, a load supported on the lifting cushion apparatus remains substantially stable as the device is inflated to elevate the load.

5 Claims, 10 Drawing Figures

AIR CUSHION LIFTING DEVICE

This invention relates to an air cushion lifting device.

It is known to use an air cushion to tilt a load about a fulcrum, for example a vehicle which has overturned. The air cushion is inserted beneath the load in a deflated condition, whereafter it is inflated so as to tilt the load about a fulcrum. However, such an air cushion cannot be used to lift a load completely off a surface, because as soon as the load loses contact with the surface, it becomes unstable, owing to the unconstrained fluidity of the air cushion.

It is an object of the present invention to provide an air cushion lifting device which is capable of lifting a load above a surface whilst substantially retaining load stability.

Viewed from a first aspect the invention provides an air cushion lifting device comprising at least one inflatable cushion having a plurality of inflatable compartments, and air supply means for supplying air to the or each cushion including a control valve for enabling all of said compartments to be inflated substantially in concert, the compartments being so arranged that, in use, a load supported only on the device remains substantially stable as the device is inflated to elevate the load.

The said compartments of the cushion could if desired be interconnected for concerted inflation only by the said air supply means, e.g. by separate tubes connected to the respective compartments and connectible to a common source of pressurised air. Preferably however the compartments are interconnected by passages within the cushion and the air supply means is connected to only one, or a minority, of the compartments.

A stack of two or more such cushions may be used to increase the height to which a load can be lifted. The cushions of such a stack may be arranged to be operated separately from one another by means of individual air supply means, or a common air supply means may be provided. In the latter case, the compartments of the air cushions may be interconnected in the vertical direction. Alternatively two or more such cushions may be used at laterally spaced locations beneath a load.

Thus viewed from a second aspect the invention provides an air cushion lifting device comprising a plurality of inflatable cushions each having a plurality of inflatable compartments, and air supply means for supplying air to all of the said cushions for enabling all of said compartments to be inflated, the compartments of each cushion being so arranged that, in use, a load supported only on the device remains substantially stable as the device is inflated to elevate the load. Preferably, as before, the compartments of each cushion are interconnected by passages within the cushion and the air supply means is connected to only one, or a minority, of the compartments. Preferably the said air supply means includes a control valve. The arrangement may be such that, in use, all of the compartments of all of the cushions are inflated substantially in concert. Alternatively, control means, e.g. a suitable differential directional flow valve, may be provided for selectively inflating the respective cushions or even individual compartments thereof, which facility may for example be used to level a load.

Thus two or more optionally compoundly constructed air cushions embodying features of the present invention can be arranged at different locations beneath a load, and by controlling the amount of air in each of the cushions, the angle of the load relative to a base surface can be varied. The simplest form of this embodiment comprises two cushions which can be supplied with compressed air either through two separate control valves or through a single differential control valve. The two air cushions can be arranged, for example, under two sides of a load, so that the load can be tilted to one side or the other by manipulation of the control valve or valves. As a further example, four air cushions could be provided, which could be connected to a common source of compressed air via a four-way control valve which could be operated by a joystick, thus allowing the operator to control the inclination of the load relative to the base surface in a simple and direct manner.

A device according to the invention may be used as a long-term support for a load.

Thus viewed from a third aspect the invention provides apparatus including, as an integral underneath support, an air cushion lifting device in accordance with the first or second aspects of the invention set forth above, with or without the various optional features of those devices already discussed. Such an apparatus can be of the most varied kinds, indeed of any kind which is capable of being supported by such a lifting device, for example a container such as a shipping container, a pallet, or a portable cabin.

When an air cushion device is used in this manner, it may be used in a partially inflated condition so as to act as a resilient suspension for the load, whereby any shocks or vibration are isolated from the load. When an air cushion device is intended for use as a long-term support, it may be desirable to provide a sensor to detect the amount of air in the or each cushion, the sensor being connected to a control valve which is connected between the cushion and a reservoir of compressed air. When the sensor detects a sinking of the load height, it automatically allows compressed air to flow from the reservoir to the cushion. The device may also be provided with a load height detector or an excess pressure relief valve. Then, in one particular application, if the device is used to support a load in an unpressurised compartment of an aircraft, as the aircraft gains height and the pressure reduces, air will be released from the cushion through the relief valve, and as the aircraft descends, the pressure will be restored in the cushion by means of the sensor arrangement described above.

The or each cushion is made of an impervious material which may be elastic, or can be reinforced for use at high working pressures. Suitable materials include rubber, polymeric or other synthetic material sheeting, with or without fibrous fabric reinforcements and woven fabrics treated so as to be rendered impermeable. It should, however, be noted that, in general, comparatively low pressures may be used. Thus, for example a cushion inflated to 2 p.s.i.g. will produce a lift of 288 lbs for each square foot of surface in contact with the load.

The compartments of the or each cushion can each extend right across the cushion and be interconnected by transverse and inter-cushion connecting air passages. Such compartments will be substantially cylindrical when inflated without a load. The cushion can, however, be divided into compartments in any desired manner, for example by quilting so that the compartments are square or lozenge shaped.

Some embodiments of the invention will now be described by way of example and with reference to the accompanying drawings, in which.

Figure 1:
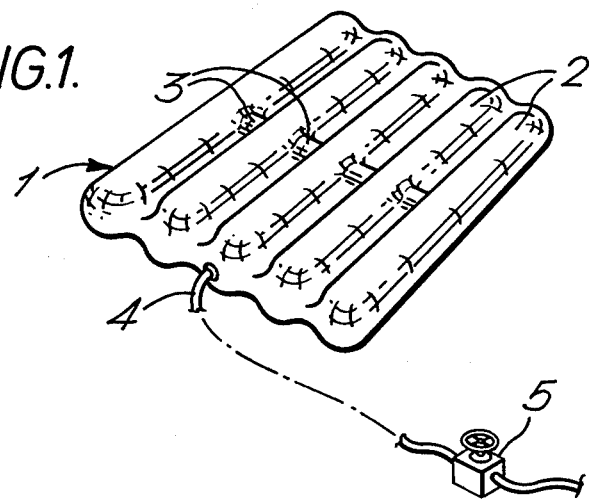
FIG. 1 is a perspective view of an embodiment of an air cushion lifting device according to the invention.
Figure 2:
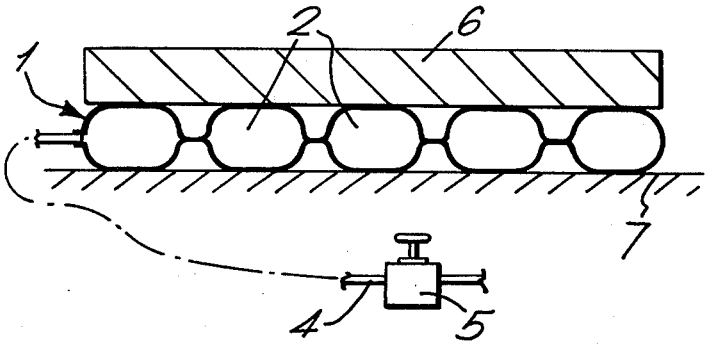
FIG. 2 is a cross-section through the device shown in FIG. 1, in use.

As shown in FIGS. 1 and 2, an air cushion lifting device comprises an inflatable cushion 1 divided into five inflatable compartments 2. Each of the compartments 2 extends the full length of the cushion 1 and is connected to adjacent compartments 2 by means of air ways 3. The cushion is connected to a source of compressed air, for example a bottle or a compressor, by air supply means comprising a flexible air supply line 4 in which is arranged a control valve 5. The cross sections of the airways 3 are smaller than the cross sections of the compartments 2, and therefore comprise restricted passageways between the compartments. In use, the cushion is interposed between a load 6 and a surface 7, and the control valve 5 is opened, thus lifting the load 6 above the surface 7 in a stable manner. When the load has been lifted to the desired height, the control valve is turned off and the load 6 is supported by the cushion 1 above the surface 7. The cushion 1 may be provided with an excess air pressure relief valve (not shown).

Figure 3:
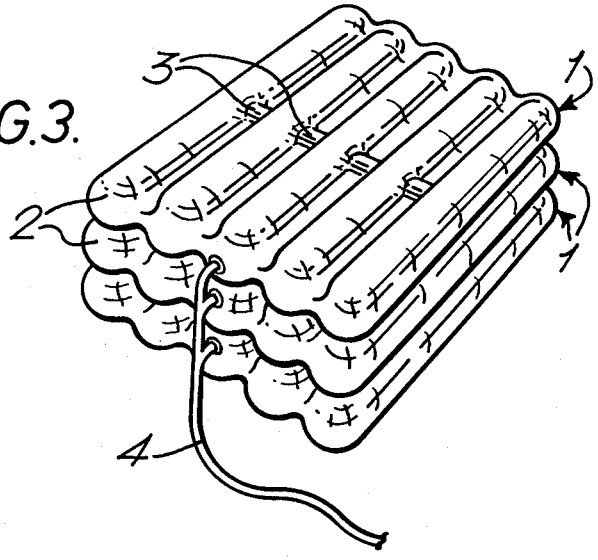
FIG. 3 is a perspective view of a second embodiment of a device according to the invention.
Figure 4:
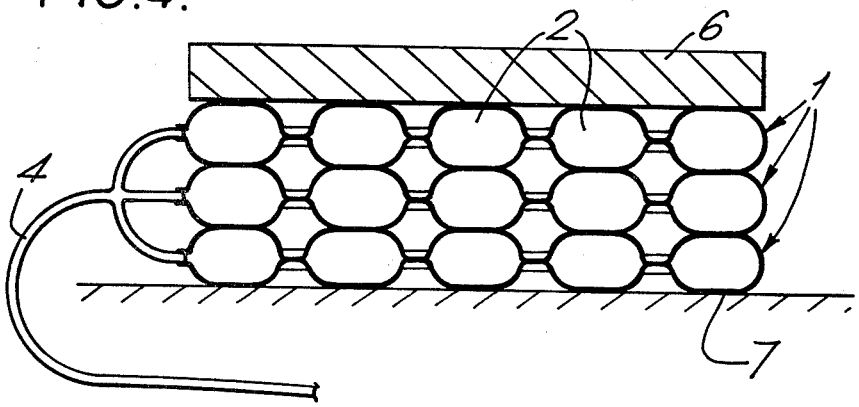
FIG. 4 is a cross-section through the device shown in FIG. 3, in use.

Referring now to FIGS. 3 and 4, a device according to the invention comprises three inflatable cushions 1. Each of the cushions is identical to the cushion of FIGS. 1 and 2 and will therefore not be described further. The cushions are connected to a common source of compressed air by a flexible supply line 4. This embodiment is capable of lifting a load to approximately three times the height which can be achieved with the embodiment of FIGS. 1 and 2 at the same air pressure.

Figure 5:
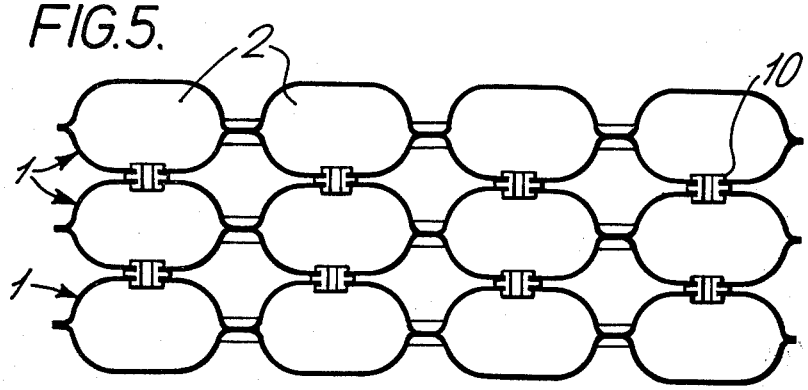
FIG. 5 is a cross-section through a third embodiment of a device according to the invention.
Figure 6:
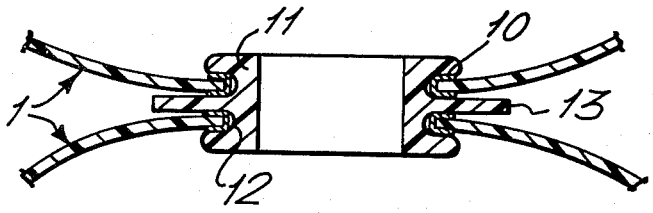
FIG. 6 is an enlarged portion of FIG. 5.
Figure 7:
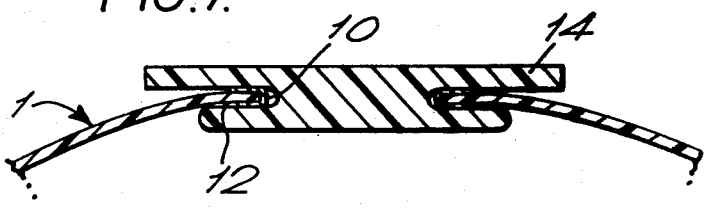
FIG. 7 is a further enlarged portion of FIG. 5.

FIG. 5 shows a device similar to that of FIGS. 3 and comprising a stack of three cushions 1, each divided to four compartments 2. However, the compartments are interconnected in the vertical direction by apertures 10. One such aperture is shown in detail in FIG. 6. Each compartment 2 has an aperture therein surrounded by a metal ring 12. The apertures of adjacent cushions are interconnected by grommets 11, made of rubber or a rubber-like material. When a load is applied to the stack of cushions, the downward force tends to force the walls of the compartments surrounding the apertures into contact with the central disc 13 of the grommet, thus producing an air-tight seal. The upper and lowermost cushions can have apertures therein on the top and underneath thereof respectively closed by discs 14 made of rubber or a rubber-like material as shown in FIG. 7. The cushions can thus be stacked in any desired number so as to provide the desired lifting.

Figure 8:
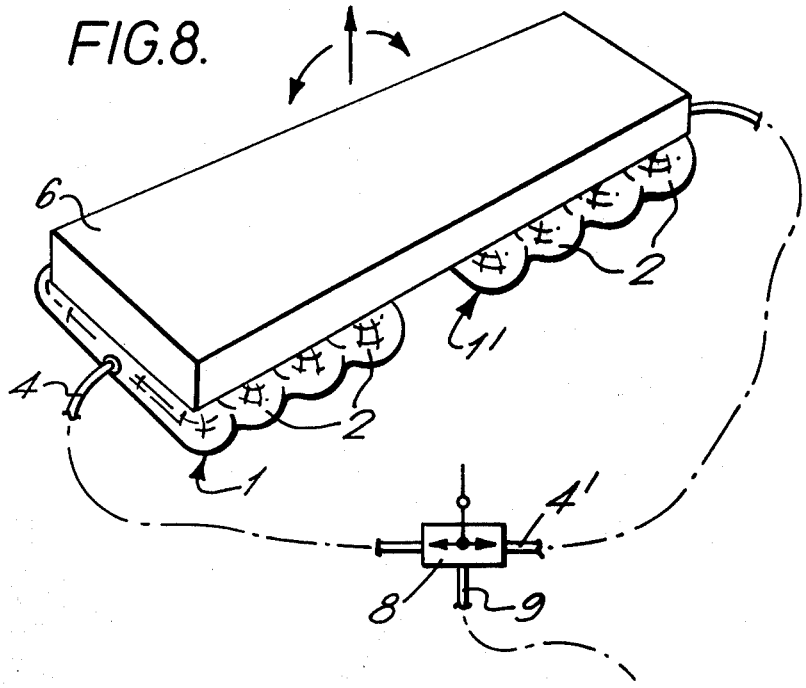
FIG. 8 is a perspective view of a fourth embodiment of a device according to the invention.
Figure 9:
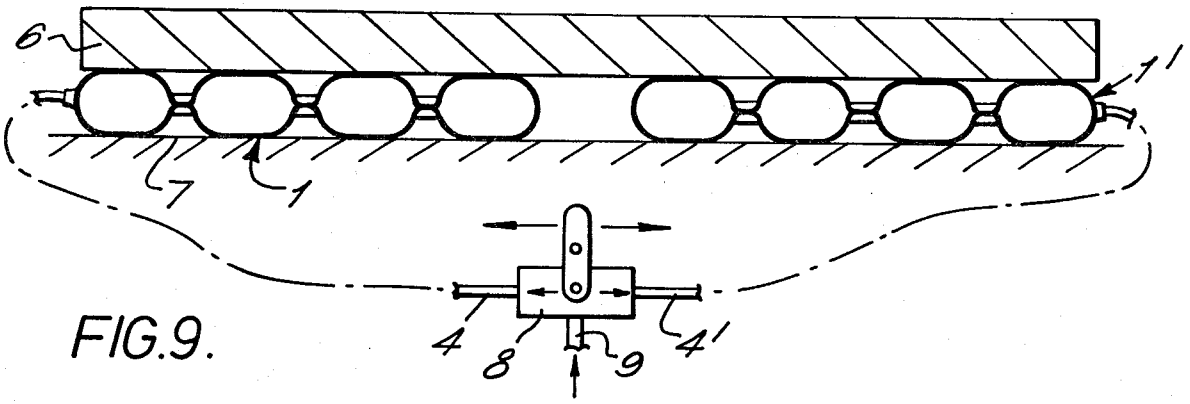
FIG. 9 is a cross-section through the device shown in FIG. 8.

The device shown in FIGS. 8 and 9 comprises two inflatable cushions 1, 1', both of which are identical to that shown in FIGS. 1 and 2. The cushions 1, 1' are connected by air supply line 4, 4' to a differential directional flow control valve 8 which in turn is connected to a souce of compressed air by a supply line 9. The differential control valve is arranged so that when an operator tilts the control handle to the left, more air is supplied to the left hand cushion 1 through the supply line 4 than to the right hand cushion 1' through the supply line 4', and vice versa. In this manner, the operator can control the inclination of the load 6.

Figure 10:
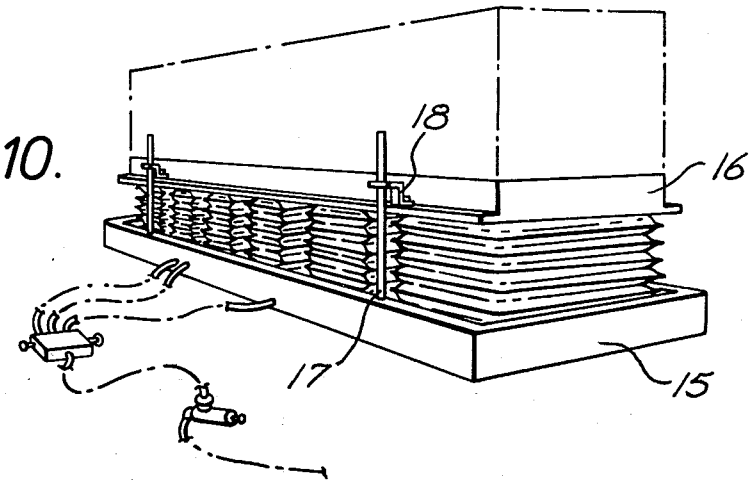
FIG. 10 is a perspective view of a further embodiment of the invention.

As shown in FIG. 10, an air cushion lifting device comprises six stacks, each consisting of six inflatable cushions 1. The cushions are interconnected vertically, as shown in FIG. 5, and each stack is connected to an air compressor through a control valve 5 which is capable of supplying air preferentially to the stacks at each end of the load 6, whereby the inclination of the load can be controlled by the operator. It has been found that this embodiment is capable of lifting a load of 2600 lb (1180 kg) with a working pressure of 1.6 psi (0.112 kg/cm$^2$) using a total lifting area of 3966 in$^2$ (2.5 m$^2$). The load can be elevated to a height of 19.5 in (0.5 m) in 2.5 minutes using an air blower which provides an air flow of 10 cfm (0.28 m$^3$/min).

The stacks of cushions are arranged in a tray 15 which receives the load bearing member 16 when the cushions are deflated. In this manner, the cushions are protected from damage when the device is not in use. Four rods 17 are vertically mounted around the perimeter of the tray 15 and the member 16 is provided with four brackets 18 each of which surrounds and is slidable relative to one of the rods 17. In this manner, the member 16 is stabilised relative to the tray 15 in the elevated and partially elevated positions of the device.

What we claim is:

1. An air cushion lifting device comprising a plurality of layers of inflatable cushions, each layer comprising a plurality of inflatable compartments, and air supply means for supplying air to said compartments for enabling all of said compartments to be inflated substantially in concert, the compartments being interconnected in the vertical direction by restricted passages and so arranged that, in use, a load supported only on the device remains substantially stable as the device is inflated to elevate the load.

2. A device as claimed in claim 1, wherein said plurality of layers of inflatable cushions are provided at a plurality of horizontal spaced locations.

3. A device as claimed in claim 2, further comprising a control valve to enable said cushions at said spaced locations to be inflated differentially.

4. A device as claimed in claim 1, further comprising a load bearing member for the load and a base member supporting said cushions, said load beaing member and said base member being interconnected for additional stability of the load.

5. A device as claimed in claim 1, further comprising an excess pressure relief valve.

* * * * *

UNITED STATES PATENT AND TRADEMARK OFFICE

CERTIFICATE OF CORRECTION

PATENT NO. : 4,275,869

DATED : June 30, 1981

INVENTOR(S) : Harold J. Clements

It is certified that error appears in the above—identified patent and that said Letters Patent is hereby corrected as shown below:

On page 1 of the specification, the Assignee should read:

Modern Precision Engineers and Associates Limited, Ashford, Kent, England.

Signed and Sealed this

*Twenty-third* Day of *February 1982*

[SEAL]

*Attest:*

GERALD J. MOSSINGHOFF

*Attesting Officer* *Commissioner of Patents and Trademarks*